United States Patent [19]

Blankenzee

[11] Patent Number: 4,893,809

[45] Date of Patent: Jan. 16, 1990

[54] JUMP BALL

[75] Inventor: Joseph L. Blankenzee, Bodegraven, Netherlands

[73] Assignee: Interchain N.V., Curaçao, Netherlands Antilles

[21] Appl. No.: 892,949

[22] Filed: Aug. 4, 1986

[30] Foreign Application Priority Data

Aug. 5, 1985 [NL] Netherlands ..... 8502188
Oct. 2, 1985 [NL] Netherlands ..... 8502690

[51] Int. Cl.[4] ..... A63B 25/08
[52] U.S. Cl. ..... 272/114; 272/93
[58] Field of Search ..... 272/114, 126, 146, 70.3, 272/93, 1, 144, 33, 65, 66; 273/58 C, 424, 425, 428; 446/220, 225; 36/7.8, 132

[56] References Cited

U.S. PATENT DOCUMENTS 1,385,642 7/1921 Restein ..... 273/58 C
1,594,479 8/1926 Swofford ..... 272/114
2,490,031 12/1949 Core ..... 273/424
3,604,726 9/1971 Tracy ..... 272/114
3,716,229 2/1973 Van Der Cleven et al. ..... 272/114
4,262,911 4/1981 Opresik et al. ..... 273/428

FOREIGN PATENT DOCUMENTS 7005221 10/1971 Netherlands ..... 272/114
370108 4/1932 United Kingdom ..... 272/114

*Primary Examiner*—Richard J. Apley
*Assistant Examiner*—S. R. Crow
*Attorney, Agent, or Firm*—Robert C. Podwil

[57] ABSTRACT

A jump ball comprising an inflatable flexible ball body and a rigid annular plate, the ball body being confined when the ball body is in its inflated condition, and coupling between the ball body and annular plate being accomplished by means of interlocking and mutually confining male and female parts. The female part is preferably a groove in which the male part fits. The groove is preferably present in the ball body.

7 Claims, 4 Drawing Sheets

JUMP BALL

BACKGROUND OF THE INVENTION

This invention relates to a so-called "jump ball", and more particularly to a toy or sports device consisting of an inflatable ball body of an elastic material and an associated rigid annular plate. When the ball body is in the inflated condition, the plate is mechanically interlocked with the body.

Such a jump ball is generally known and is shown and described, for example, in the published Dutch Patent Application No. 7005221 and in the U.S. Pat. No. 3,716,229. Known jump balls consist of an inflatable ball-shaped body made of an elastic material, for example an elastic plastic, such as polyvinyl chloride. The manufacture of such a ball body is carried out with the aid of a rotation casting mold, whereby the wall of the ball body is formed by introducing plastic into a heated mold and distributing it over the inner wall of the mold by the effect of centrifugal forces.

The annular plate may consist of any sufficiently rigid material, but is usually made of injection molded plastic. A suitable plastic is polyethylene.

For known jump balls, the connection between the annular plate and the ball body is effected either by welding these parts together or exclusively by friction between the parts.

Welding has the disadvantage that it requires an extra manufacturing step and also carries with it the risk that weak spots may arise in the wall of the ball body or the connection between the elastic, relatively soft plastic of the ball body and the hard plastic of the plate. Also, the plastic of the plate may not everywhere be of adequate quality.

The most frequently used connection technique relies on the friction created during inflation, when the ball body, due to its expansion, is jammed into the opening of the plate. Bulges are formed in the ball body above and below the plate, so that the plate is jammed into a groove thus formed in the ball body.

Jump balls are used as toys or sporting goods. During their use, very high loads may occur at the connector between the plate and ball body, and such loads must be absorbed by the weld or friction connection between these elements. If the pressure in the ball body decreases, as it always does over some time, a danger exists that the annular plate will suddenly slip from the ball body. In that event, not only may the plate and the user standing thereon fall, but the ball body, still under some pressure, may slip from the annular plate with great force. Accidents of these sorts have actually taken place.

BRIEF DESCRIPTION OF THE INVENTION

An object of this invention is to now provide a jump ball in which the connection between the ball body and the annular plate is such that, without a welded connection, such a tight connection is created that slipping is prevented. The invention further aims to achieve this object independently of the overall shape of the ball body, and also for a ball body which does not have a groove formed by inflation.

The above objects of this invention are achieved according to the invention, in that in the inflated condition of the ball body, the ball body is coupled to the annular plate by interlocking mean, constraining the annular plate from movement in the axial direction of the ball. The interlocking means comprise continuous peripherally extending male and female profile parts of the ball body and the plate respectively, the profile part of the ball body being integral with the ball body and consisting of the same material.

The interlocking profile parts provide for confinement of the ball body in the ring defined by the plates under all conditions, even in the event of a decrease of pressure in the ball body.

It is possible according to the invention that the female profile be made in the ball body, to consist of an annular groove whose bottom is inward from the opening. The male profile of the plate may fit into the opening of the groove.

However, it is also possible, as an alternative, that the female profile be made to consist of a groove in the inner edge of the plate and the male profile to consist of a cast radially extending flange of the ball body.

Interlocking profile parts of many shapes are conceivable. Thus the groove in the ball body may be U-shaped or dovetail-shaped in cross-section, or may have a bottom which is angled with respect to the vertical center-line of the ball body. The inner edge of the plate, fitting into the groove, preferably has a similar shape, so that it fits properly into the groove.

If a flange is provided on the ball body it is may likewise be rectangular, dovetail-shaped or slanted in cross-section and fitted into a complementary shaped groove in the inner edge of the plate.

When the groove is in the ball body, it is useful that the legs of the groove, when seen in cross-section, have a thickened wall portion at their outwardly extending ends. Such a configuration improves the jamming of the edge of the plate, and also increases the moment of resistance of the groove profile against deformation.

A radial flange at the ball body will have a T-shaped profile extending in a peripheral direction from its transition into the ball body. Such a profile form provides a high resistance against bending of the flange.

DESCRIPTION OF PREFERRED EMBODIMENTS

Figure 1:
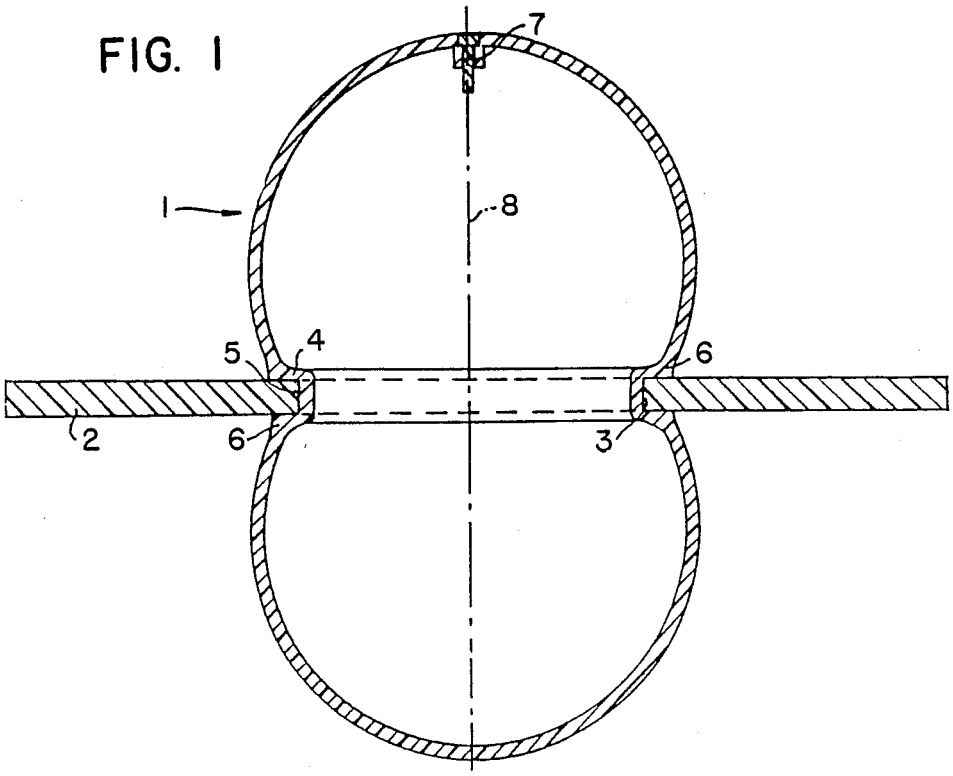
FIG. 1 shows in cross-section a first embodiment of the jump ball according to the invention.

Referring now to the drawings in detail, in which like reference numerals indicate like elements, there is seen in FIG. 1 a jump ball having a ball body 1 in inflated condition with the annular plate 2 mounted. The jump ball, as well as those of the other embodiments, is manufactured in a rotation mold. This mold is provided with an interior profile as will be described below in reference to FIG. 5, such that a groove 3 of U-shaped cross-section is formed in the wall of the ball body. The groove 3 has radially outwardly extending legs 4 and a bottom 5. The legs have thickened portions on their outer ends, of which the outer face is substantially perpendicular to the plate.

At 7 is a valve for inflating the ball.

In the inflated condition shown in FIG. 1, the U-shaped groove 3 is radially expanded in such a way that it fully confines the inner edge of the plate 2. Confinement of the plate 2 is not only in a radial direction, but also in an axial direction, i.e., in the direction of the vertical center line 8 of the ball body. The load occurs in directions which substantially correspond with that of the center-line 8 of the ball body, or, in the case of unequal loads on the two sides of the plate, form small angles with the center-line 8.

It should now be obvious from the drawings that even if pressure within the ball body decreases somewhat, very secure confinement of the plate 2 is nevertheless obtained.

Upon inflation, the ball assumes a shape in cross-section which is sometimes referred to as "eight-shape", and which consists of more or less sphere-shaped bulges under and above the plate 2, respectively.

In addition it will be apparent that in the non-inflated condition the ball body may be positioned with ease into the opening of the plate 2.

Figure 2:
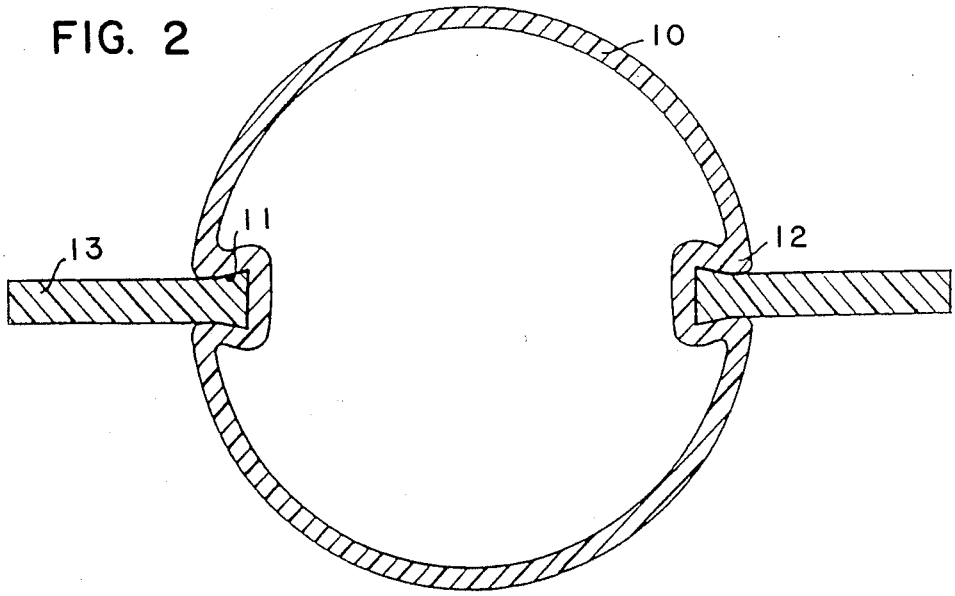
FIG. 2 shows a cross-section of another embodiment of the jump ball according to the invention.

FIG. 2 shows an embodiment whereby the ball body 10 is sphere-shaped in inflated condition. This ball body is manufactured in a rotation mold in such a way that a groove 11 is formed, extending in a peripheral direction but dovetail-shaped in cross-setion. At the extremes of the legs of the groove, thickenings 12 have been formed here as well, as a consequence of the manufacturing method. The plate 13 has at its edge a profile that fits into the dovetail-shaped groove.

Figure 3:
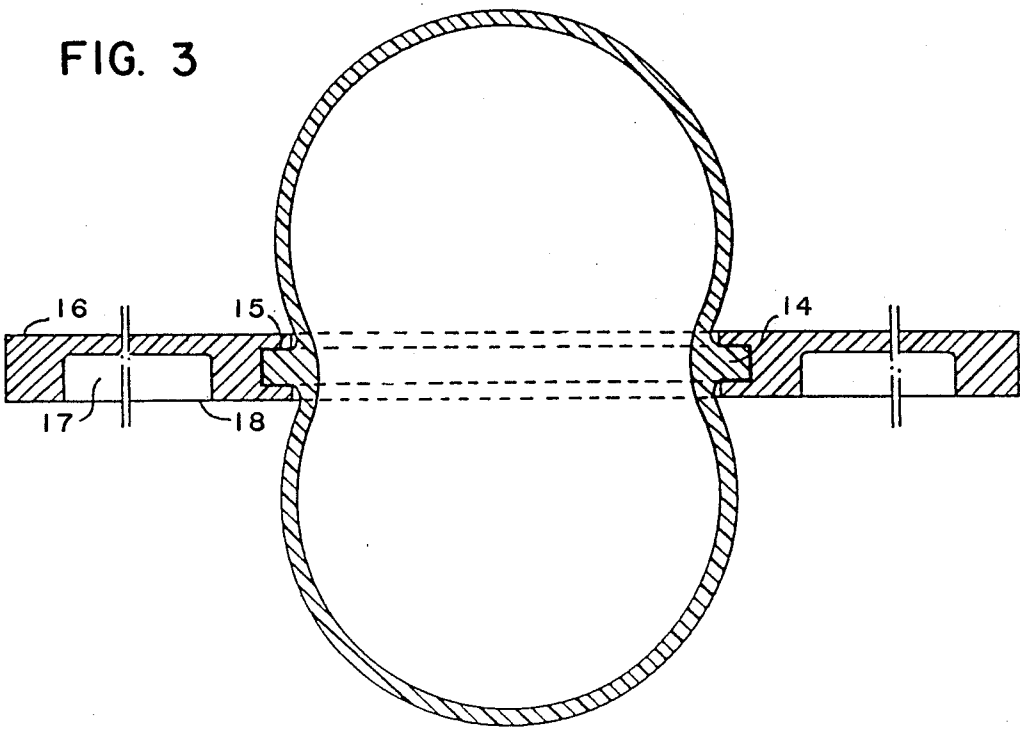
FIG. 3 shows in cross-section a third embodiment of the jump ball according to the invention.

Referring now to FIG. 3, another embodiment is shown in which the ball body is represented in an inflated condition. This embodiment is provided at its periphery with a flange 14 of rectangular cross-section, which fits into a correspondingly shaped groove 15 of an annular plate 16. The plate 16 has a flat upper face and is provided at its bottom with recesses 17 (to save weight), and reinforcement ribs 18.

Figure 6:
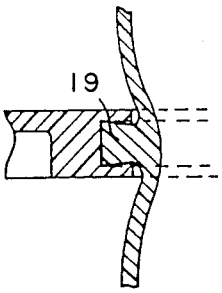

FIG. 6 shows that the flange in the corresponding groove may have a dovetail-shaped profile 19.

Figure 7:
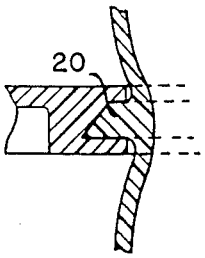
FIGS. 6 and 7 show schematically, in cross-section, variations on the flange connection of the embodiment of FIG. 3.

FIG. 7 shows that the flange may have a profile slanted as at 20.

Figure 4:
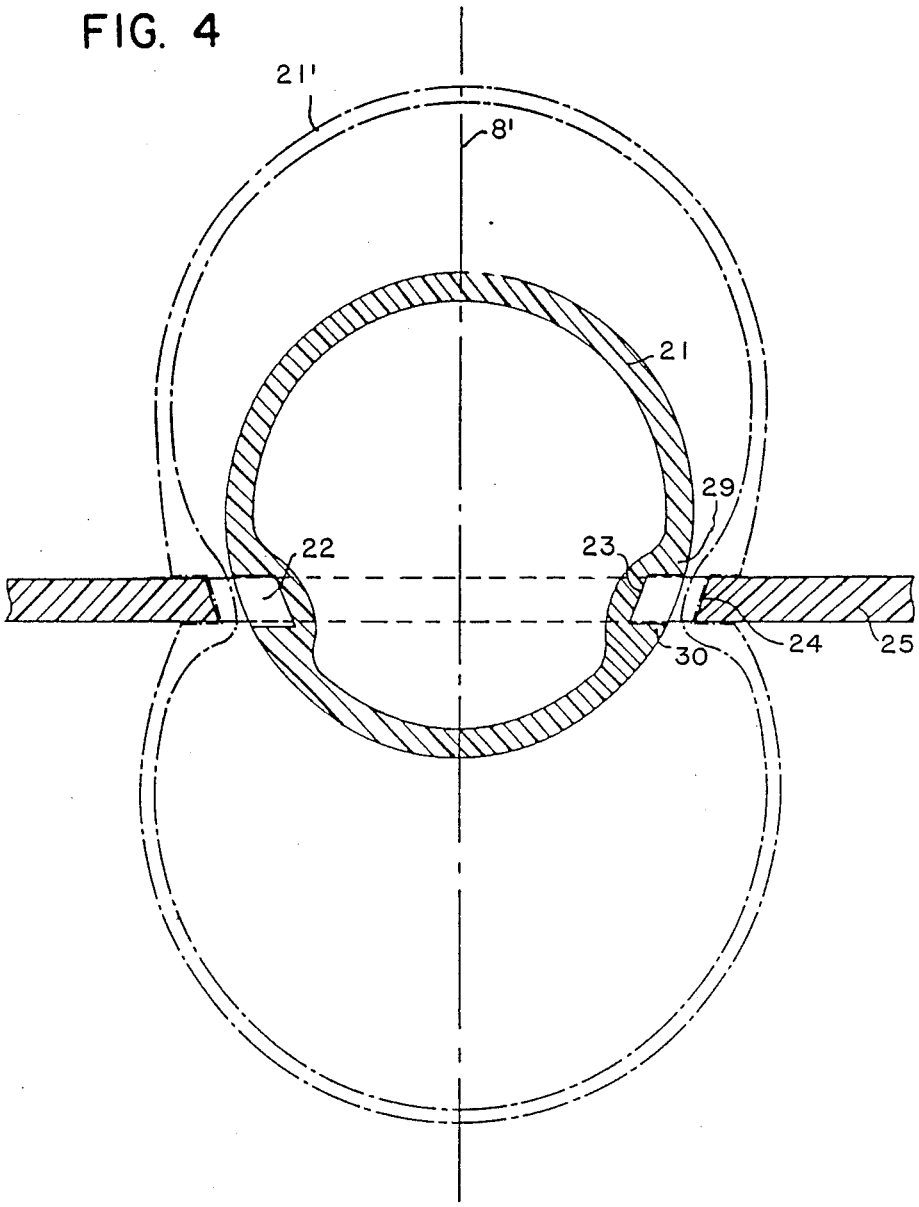
FIG. 4 shows in cross-setion a further embodiment of the ball body, in non-inflated condition with solid lines and the inflated condition with broken lines.

FIG. 4 shows a ball body 21 in non-inflated condition as provided by the mold. As is apparent, the ball body 21 is provided with a circular groove 22, which in this embodiment has a bottom 23, which extends at an angle with respect to the vertical center line 8. The groove 22 cooperates with a slanted inner edge 24 of an annular plate 25. The inflated condition, in which the inner edge of the plate 25 and the groove 22 thus interlock, is shown by dotted lines 21.

Figure 5:
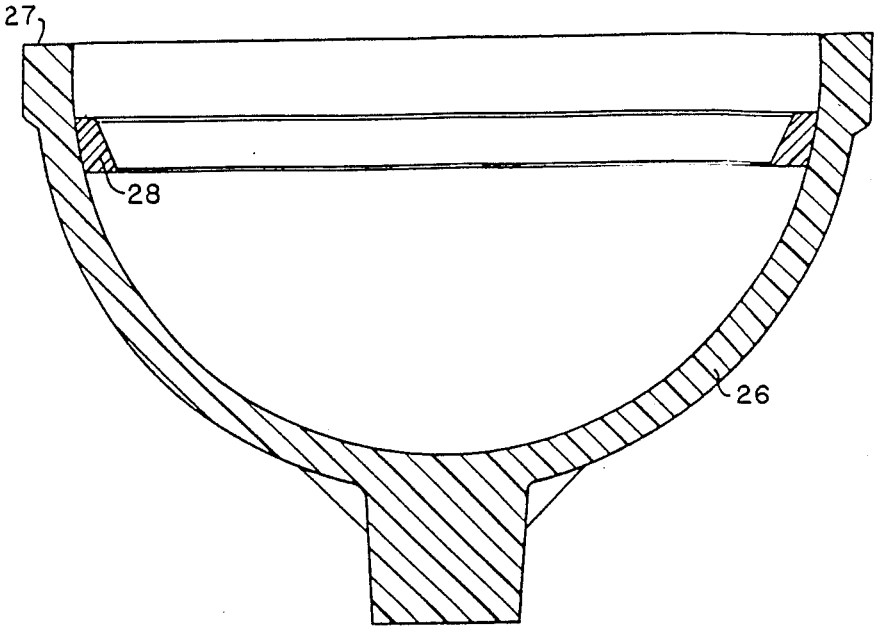
FIG. 5 shows a part of a mold for manufacturing the jump ball according to FIG. 4.

FIG. 5 shows the lower half of a rotation mold 26 for the manufacture of the ball body 21, of FIG. 4. The upper half of this mold is not shown. The upper half, it will be understood, has an edge, which complements and connects with the edge 27 of the mold 26, and an inner spherical shape which forms the extension of the inner spherical shape of the illustrated lower half 26. In the lower half of the mold 26 a ring 28 is positioned. The ring 28 , it will be seen, determines the shape of the groove 22. Comparing now the embodiment of FIG. 4 and following the profile of the wall on both sides of the groove, it should now be apparent that the thickenings 29 and 30 are automatically formed during the rotation process by the shape of the ring 28.

In accordance with the embodiment of FIG. 4, the groove 22 is located in a plane transverse to the vertical center-line and below the medial (central) horizontal plane through the center of the ball body 21.

If it is desired to manufacture ball bodies such as the ones shown in FIG. 1 or 2, a ring will be placed in the mold at the level of the central dividing plane. As above, the ring determines the profiles of the grooves 3 and 11, and thus also the profiles of the thickenings 6 and 12, respectively.

In connection with the embodiments of FIGS. 3, 6 or 7 the wall of the mold is provided with a circular groove, which is filled during the rotation process at the location where the flange is to be formed.

For the sake of completeness it is observed that the manufacture of a jump ball by means of a rotation process with foot supports formed as integral cast parts thereof is known as such from British Patent Specification No. 1,297,837. Foot supports formed integral with the ball body have, however, the disadvantage that the mold is very expensive due to the large radial dimensions of the foot supports. Moreover, because the foot supports have to be made from the same material as the ball body, they are relatively soft.

Reference should be made to the appended claims rather than the foregoing specification as indicating the scope of the invention.

I claim:

1. Recreational apparatus comprising an inflatable ball body of elastic material of sufficient strength to support the weight of a person and a rigid annular plate operatively coupled to said ball body and of sufficient strength to support the weight of a person, and means for mechanically interlocking said ball body and said plate when said ball body is inflated so that said plate is disposed intermediate the top and the bottom of the ball body and constrained from movement in an axial direction with respect to said ball body, said means for mechanically interlocking said ball body and said plate comprising male and female profile parts, said female profile parts being integral with said ball body and comprising an annular groove, the bottom of said groove facing generally outwardly, said male profile part comprising a portion of said plate and adapted to fit into said groove and to seat therein when said ball body is inflated, the cross-section of said groove being defined by outwardly extending walls of said ball body, said walls having thickened portions at their radial outward extremes for supporting said plate and the weight of a person.

2. Apparatus in accordance with claim 1, wherein the bottom of said groove is disposed radially inwardly from the opening of said groove and the surface of said ball body, the thickness of said male profile part corresponding to the width of said groove.

3. Apparatus in accordance with claim 2, wherein said groove is generally U-shaped in cross-section.

4. Apparatus in accordance with claim 2, wherein portions of said outwardly extending walls of said ball body extend generally parallel to the surface of said male profile part when said ball body is inflated, whereby inflation of said ball body causes said outwardly extending walls to firmly engage respective opposite faces of said male profile part.

5. Apparatus in accordance with claim 4, wherein said groove is generally U-shaped in cross-section.

6. Apparatus in accordance with claim 1, wherein said groove is dovetail-shaped in cross-section and said male profit part is complementary dovetail shaped in cross-section.

7. Apparatus in accordance with claim 1, wherein the bottom of said groove, viewed in cross-section, is angularly disposed with respect to the vertical center line of said ball body and male profile part is complementary shaped.

* * * * *

UNITED STATES PATENT AND TRADEMARK OFFICE

CERTIFICATE OF CORRECTION

PATENT NO. : 4,893,809

DATED : January 16, 1990

INVENTOR(S) : Joseph L. Blankenzee

It is certified that error appears in the above-identified patent and that said Letters Patent is hereby corrected as shown below:

In the Claims

In Column 5, Claim 6, in Line 3, delete "complementary" and insert -- complementally--.

In Column 6, Claim 7, in Line 3, delete "complementary" and insert -- complementally--.

Signed and Sealed this

Twenty-second Day of January, 1991

*Attest:*

HARRY F. MANBECK, JR.

*Attesting Officer*

*Commissioner of Patents and Trademarks*